US010728961B2

(12) United States Patent
Corda

(10) Patent No.: US 10,728,961 B2
(45) Date of Patent: Jul. 28, 2020

(54) GRAPHITE COMPOSITE COOKING PLATE

(71) Applicant: GARLAND COMMERCIAL INDUSTRIES LLC, New Port Richey, FL (US)

(72) Inventor: Arnel Corda, Herisau (CH)

(73) Assignee: Garland Commercial Industries LLC, New Port Richey, FL (US)

( * ) Notice: Subject to any disclaimer, the term of this patent is extended or adjusted under 35 U.S.C. 154(b) by 232 days.

(21) Appl. No.: 14/827,996

(22) Filed: Aug. 17, 2015

(65) Prior Publication Data

US 2016/0050721 A1 Feb. 18, 2016

Related U.S. Application Data

(60) Provisional application No. 62/038,536, filed on Aug. 18, 2014.

(51) Int. Cl.
*H05B 6/12* (2006.01)

(52) U.S. Cl.
CPC ..... *H05B 6/1209* (2013.01); *H05B 2214/04* (2013.01)

(58) Field of Classification Search
CPC ..... H05B 2214/04; H05B 6/1209; H05B 6/12–6/129
USPC ..... 219/622
See application file for complete search history.

(56) References Cited

U.S. PATENT DOCUMENTS 4,646,935 A 3/1987 Ulam
5,866,884 A * 2/1999 Cornec ..... H05B 6/1263 219/622
5,901,699 A 5/1999 McDermott
5,910,210 A * 6/1999 Violi ..... A47J 39/006 165/64
6,657,170 B2 12/2003 Clothier
6,670,589 B2 * 12/2003 Wyatt ..... H05B 6/12 126/246
8,021,135 B2 * 9/2011 Anbarasu ..... B29C 33/06 219/600
2007/0108192 A1 3/2007 Kataoka et al.
2009/0065499 A1 3/2009 England
(Continued)

FOREIGN PATENT DOCUMENTS

DE 8716927 U1 2/1988
DE 19813996 A1 12/1999
(Continued)

OTHER PUBLICATIONS

International Search Report dated Jan. 11, 2016 from corresponding PCT/US2015/045496, pp. 3.
(Continued)

*Primary Examiner* — Michael A LaFlame, Jr.

(74) *Attorney, Agent, or Firm* — Ohlandt, Greeley, Ruggiero & Perle, LLP

(57) ABSTRACT

A thermal composite which can be used in induction heating or cooking devices. The composite comprises a surface layer made of a food-safe material, an induction layer made of a carbon-based material, an insulation layer, and an induction heating element. The heating element heats the induction layer directly, through the insulation layer, which in turn heats the surface layer. There can also be a structural support layer between the insulation layer and the heating element.

11 Claims, 1 Drawing Sheet

(56) References Cited

U.S. PATENT DOCUMENTS

| | | | | |
|---|---|---|---|---|
| 2009/0324811 | A1* | 12/2009 | Jung | H05B 3/145 427/113 |
| 2010/0000980 | A1 | 1/2010 | Popescu | |
| 2012/0152933 | A1* | 6/2012 | Matsui | H05B 6/1263 219/623 |
| 2012/0167780 | A1 | 7/2012 | Houston | |
| 2015/0313405 | A1* | 11/2015 | Groll | A47J 36/02 220/573.1 |

FOREIGN PATENT DOCUMENTS

| | | | |
|---|---|---|---|
| DE | 10127051 | A1 | 12/2002 |
| DE | 10120500 | B4 | 8/2004 |
| JP | 2008295495 | A | 12/2008 |

OTHER PUBLICATIONS

International Written Opinion dated Jan. 11, 2016 from corresponding PCT/US2015/045496, pp. 6.
Patent Examination dated Apr. 19, 2017 from corresponding Australian Patent Application No. 2015305776, pp. 4.
Extended European Search Report dated Mar. 14, 2018 for European application No. 15833881.4.
Canadian Office Action dated Feb. 12, 2018 for Canadian application No. 2,958,334.

* cited by examiner

GRAPHITE COMPOSITE COOKING PLATE

CROSS-REFERENCED APPLICATIONS

This application claims priority to U.S. Provisional Application No. 62/038,536, filed on Aug. 18, 2014, which is incorporated herein in its' entirety.

BACKGROUND OF THE DISCLOSURE

1. Field of the Disclosure

The present disclosure relates to composite induction cooking plates. More specifically, the present disclosure relates to composite induction cooking plates that use a high-conductivity, low thermal capacity substance such as graphite in conjunction with a stainless steel heating surface.

2. Description of the Related Art

In the field of commercial and residential cooking applications, there is always a need to have even temperature distribution on the cooking surface, precise temperature control, and quick response (i.e., low thermal heat capacity) when switching temperatures. In induction heating or cooking devices, an induction coil heats a material, which then transfers that heat to the cooking surface.

Current systems of this type may include an aluminum layer connected to or sandwiched between two stainless steel layers. These systems are disadvantageous in that they have high production costs due to the multiple layers of stainless steel needed and the assembly costs involved with manufacturing such a plate. These aluminum-steel composites also have poor conductivity and high thermal capacity, meaning that they are slow to respond to changes in desired cooking temperatures. Furthermore, in current devices, the induction heater has to heat a first stainless layer, which then heats the aluminum layer, which in turn heats the second, stainless cooking layer. This requires a significant amount of energy, reduces the reaction time of temperature changes, and contains two interfaces between layers where heat transfer could be adversely affected.

Accordingly, there is a need to address these disadvantages.

SUMMARY

The present disclosure provides a composite that can be used in an induction cooking system. The composite comprises a food-safe heating or surface layer, such as stainless steel, that is connected or bonded to a very high thermal conductivity, low thermal capacity carbon-based induction layer, such as graphite. The composite further has an insulation layer between the graphite layer and an induction heating coil, as well as an additional layer and fasteners if needed to provide structural stability. As will be discussed in greater detail below, the carbon induction layer provides significant advantages for the composite plate of the present disclosure.

Thus, in one embodiment, the present disclosure provides a composite for an induction cooking device, comprising a surface layer made of a food-safe material, and an induction layer made of a carbon-based material. The composite may further comprise an insulating layer made of an insulating material, so that the induction layer is between the surface layer and the insulating layer. 3. The composite of claim 2, further comprising an induction heating element on an opposite side of said insulating material from said induction layer.

DETAILED DESCRIPTION OF THE PREFERRED EMBODIMENTS

Figure 1:
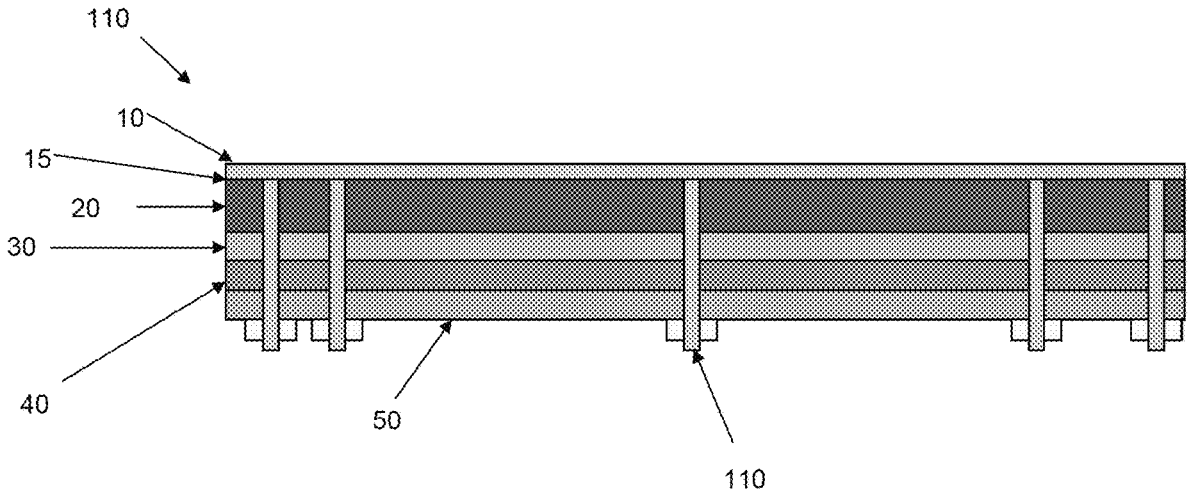
FIG. 1 shows a side plan view of the composite plate of the present disclosure.
Figure 2:
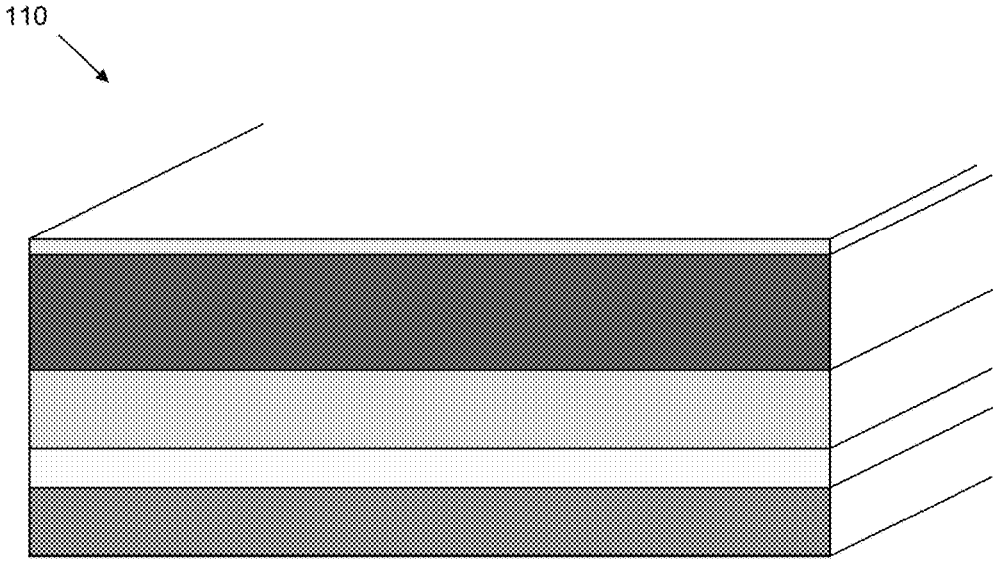
FIG. 2 shows perspective view of the composite plate of FIG. 1.

Referring to FIGS. 1 and 2, thermal composite plate 100 of the present disclosure is shown. Plate 100 has, in stacked arrangement, heating or surface layer 10, induction layer 20, insulation layer 30, support layer 40, and induction coil 50. Advantageously, induction layer 20 is made of a carbon-based material, such as graphite. Induction coil 50 heats induction layer 20 via induction, and induction layer 20 in turn transfers heating energy to surface layer 10. A food or liquid on the top of surface layer 10 can then be cooked, heated, or warmed with this energy.

The high thermal conductivity and low thermal capacity of carbon materials in induction layer 20 make them particularly well-suited for use in induction heating systems. Carbon-based materials such as graphite can be heated directly by an induction heater. This stands in contrast to currently available devices, which require that the induction heater heat a stainless steel layer, which in turn heats an aluminum layer, which in turn heats the steel cooking surface. Because of this, induction layer 20 can be directly heated by the induction coil 50, and connected to or bonded to the surface layer 10. Thus, there is only one heating interface to monitor, as opposed to the two (steel-aluminum-steel) of prior art devices.

As discussed above, induction layer 20 can be made of a carbon-based material, such as graphite. Graphite has several properties in addition to those listed above that are advantageous for use in plate 100, such as immunity to corrosion, low specific weight, high tolerance for heat (up to five hundred degrees Celsius) without mechanical deformation, and high thermal shock resistance. The carbon-based material or graphite used in induction layer 20 does not have to be completely pure carbon, but can have a carbon weight percent of between eighty and one hundred percent, or any subranges therebetween. Even if materials such as aluminum may be cheaper on a per weight basis than graphite and may be more widely available, the properties of graphite and other carbon-based materials make them well suited for use in induction heaters.

To form plate 100, induction layer 20 is connected to surface layer 10. The connection can be any of several methods, such as with compression force or press-forming, a spring-loaded force, or an adhesive 11. The interface 15 between surface layer 10 and induction layer 20 is critical, and heating losses and resistance to heat transfer are to be minimized. For example, if an adhesive is used, it should be one with favorable thermally conductive properties. One of the particular advantages of using a carbon-based material such as graphite is that graphite is a somewhat malleable or soft material, unlike the aluminum used current devices. This means that when layer 20 is compressed with or adhesively bonded to surface layer 10 at interface 15, the graphite can fill any micro-pores or rough surface grooves 12 in surface layer 10. This significantly improves the efficiency of plate 100.

Surface layer 10 can be made of a food-safe material, such as stainless steel or Inox. Other materials such as ceramic, graphene, or plastic may be used, with or without a coating (e.g., Teflon®), as long as they are able to withstand the temperatures reached with plate 100. Furthermore, surface layer 10 and/or induction layer 20 and/or insulation layer 30 could have different shapes than the flat plates as shown. The layers could also be in other shapes suitable for cooking applications—for example concave shapes as in fry pans, ranges, griddles, woks, or roasting pans. This is another way in which the softness or malleability of the graphite in layer 20 is advantageous.

Insulation later 30 is on an opposite of induction layer 20 from surface layer 10. Layer 30 provides electrical and heat insulation, preventing energy from traveling or leaking in the wrong direction, away from surface layer 10. Insulation layer 30 may also provide additional structure and support, pressing induction layer 20 against surface layer 10, and compensation for any deformation of those layers. Insulation layer 30 can also have a softness that allows for a cushioning of induction layer 20. Insulation layer 30 may be made from any suitable material that has high temperature stability, for example up to four hundred degrees Celsius, and can support induction layer 20. One suitable material for insulation layer 20 is fiberglass, but several others are contemplated.

Support layer 40 is an optional layer that can be on an opposite side of insulation layer 30 from induction layer 20. Layer 40 can also provide additional mechanical support, and energy insulation. Layer 40 can be made from one or more sub-layers of a strong material, such as mica (e.g., Micanit™). Lastly, induction coil 50 is on an opposite side of support layer 40 from insulation layer 30, and provides the induction currents that heat induction layer 20. As discussed above, due to the particularly advantageous properties of carbon-based materials like graphite, induction layer 20 can be heated directly by induction coil 50, through support layer 40 (when used) and insulation layer 30. This provides a simplicity of design and control not found in current devices. Each of the above-discussed layers can be held together with a stud and nut assembly 110 if needed.

The thickness of each of layers 10, 20, 30, and 40 can vary, depending on their use. For example, it may be desirable to have a comparably thick induction layer 20, to generate a lot of power. In some applications, more insulation may be needed than in others, thus varying the thickness of insulation layer 30.

While the present disclosure has been described with reference to one or more particular embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this disclosure.

What is claimed is:

1. A composite for an induction cooking device, said composite comprising, in consecutive layered arrangement:
- a surface layer made of a food-safe material;
- an induction layer made of a carbon-based material, wherein said induction layer is connected to or bonded to said surface layer to form an interface, wherein said induction layer fills pores or grooves in said surface layer;
- an insulating layer made of an insulating material, wherein said insulating layer contacts said induction layer; and
- an induction heating element that contacts said insulating layer and heats said induction layer via induction.

2. The composite of claim 1, wherein said food-safe material is at least one material selected from the group consisting of: stainless steel, ceramic, graphene, and plastic.

3. The composite of claim 2, wherein said food-safe material is stainless steel.

4. The composite of claim 1, wherein said carbon-based material is graphite.

5. A composite for an induction cooking device, said composite comprising, in consecutive layered arrangement:
- a surface layer made of a food-safe material;
- an induction layer made of a carbon-based material, wherein said induction layer is connected to or bonded to said surface layer to form an interface, wherein said induction layer fills pores or grooves in said surface layer;
- an insulating layer made of an insulating material, wherein said insulating layer contacts said induction layer;
- a mica support layer that contacts said insulating layer; and
- an induction heating element that contacts said mica support layer and heats said induction layer via induction.

6. The composite of claim 1, wherein said induction layer is connected to said surface layer with an adhesive.

7. The composite of claim 1, wherein said induction layer is press-formed to said surface layer.

8. The composite of claim 1, wherein each of said surface layer, said induction layer, and said insulating layer is substantially flat.

9. The composite of claim 1, wherein each of said surface layer, said induction layer, and said insulating layer have a concave shape.

10. The composite of claim 1, wherein the insulating material is a solid material.

11. The composite of claim 1, wherein the insulating material is fiberglass.

* * * * *